US005732646A

United States Patent [19]

Brandt

[11] Patent Number: 5,732,646

[45] Date of Patent: Mar. 31, 1998

[54] CONTAINER WITH RECIRCULATION SYSTEM FOR CLEANING BOAT HULLS ON LAND

[76] Inventor: Christian Brandt, Niederkasseler Strasse 15, Duesseldorf 40547, Germany

[21] Appl. No.: 635,927

[22] PCT Filed: Sep. 23, 1994

[86] PCT No.: PCT/EP94/03177

§ 371 Date: Apr. 26, 1996

§ 102(e) Date: Apr. 26, 1996

[87] PCT Pub. No.: WO95/11763

PCT Pub. Date: May 4, 1995

[30] Foreign Application Priority Data

Oct. 27, 1993 [DE] Germany ..... 43 36 675.9

[51] Int. Cl.[6] ..... B63B 39/00

[52] U.S. Cl. ..... 114/122; 134/107

[58] Field of Search ..... 134/107–109, 134/123; 114/222

[56] References Cited

U.S. PATENT DOCUMENTS

| | | | |
|---|---|---|---|
| 2,981,266 | 4/1961 | Tamburri | 134/123 |
| 3,258,019 | 6/1966 | Bellas et al. | 134/123 |
| 4,279,263 | 7/1981 | Pulliam . | |
| 5,111,762 | 5/1992 | Frangiamore . | |

FOREIGN PATENT DOCUMENTS

| | | |
|---|---|---|
| 0178091 | 4/1986 | European Pat. Off. . |
| 3807331 U | 9/1988 | Germany . |
| WO 93/02912 | 2/1993 | WIPO . |

*Primary Examiner*—Ed L. Swinehart

*Attorney, Agent, or Firm*—Townsend and Townsend and Crew LLP

[57] ABSTRACT

A boat hull cleaning system, particularly for sail and motor yachts, prevents the contamination of sewers and open waters by recirculating the cleaning water within the system without discharging it therefrom. The system includes a trailerable container, of a size up to the size of conventional, large ocean-going shipping containers, which is fitted with a catch basin having side and end walls that extend upwardly thereon. Hinges between the basin and the walls permit the latter to be folded downwardly into a position in which the walls are downwardly inclined towards the basin. Corner plates connect the adjacent edges of the side and end walls and with the latter form a water drain surface which directs used, contaminated water into the basin. The basin is covered with a water permeable, metal mesh floor which carries supports for holding the boat hull during cleaning. A steam-hot water generator and a used water treatment apparatus are in flow communication with the catch basin and with connectors mounted on the basin for flowing steam and/or hot water through a flexible hose for discharge onto and cleaning of the exterior of the boat hull. Used water is recirculated from the basin and through appropriate piping via the used water treatment apparatus and the steam/hot water generator back to the flexible hose for discharge therefrom as a high pressure jet so that substantially all water can be repeatedly used for cleaning the hull and no water is discharged into sewers or the environment.

12 Claims, 2 Drawing Sheets

CONTAINER WITH RECIRCULATION SYSTEM FOR CLEANING BOAT HULLS ON LAND

BACKGROUND OF THE INVENTION

1. Field of the Invention

This invention relates to cleaning systems for boat hulls, particularly of sail and motor yachts.

2. Description of the Prior Art

Sports and recreational boats, particularly sail and motor yachts, are frequently cleaned with steam or high pressure water by placing the hulls of the boats on suitable support structures located in the vicinity of a port, on docks, on club properties and the like. Algae, dirt and other contaminants are removed from the boat hull with the steam and/or high pressure water. The contaminated, used water flows into sewers or directly back into open waters. Such a removal of the water leads to a significant contamination of waste water and/or of open waters because the water contains the substances washed from the hull such as grease or oil, a variety of chemicals, anti-fouling preparations, paint, lacquer and plastic remnants, solvents and the like. Such substances are difficult or impossible to remove in conventional sewage treatment plants and, if discharged into the environment, can compromise the survival of or destroy organisms living in such waters. These observations also apply to the cleaning system disclosed in U.S. Pat. No. 5,111,762, which is mounted on a conventional boat trailer.

Environmental concerns therefore mandate that the conventional way of cleaning boat hulls must be changed. Presently available, permanent installations for capturing contaminated water and cleaning it found in the vicinity of ports and docks typically are capable of only removing oil and paint residues and, therefore, effect only an initial decontamination of the water. They cannot prevent a significant contamination of the sewage water, or open water into which it is discharged, with contaminants remaining in the wash water.

It is also known to provide permanent boat hull cleaning installations with a subterranean sedimentation basin for collecting used water from the installation. The water is filtered and recirculated for use. Such installations require large working areas and are quite expensive.

SUMMARY OF THE INVENTION

It is an object of the present invention to provide a boat hull cleaning system which is mobile, so that it can be used at different localities, and which prevents the contamination of sewers and open waters.

This object is achieved with a cleaning system that includes a transportable container defined by a catch basin at a lower end of the container and container walls extending upwardly from the basin when the container is closed and foldable downwardly and outwardly relative to the basin, and corner plates extending between the container walls when folded downwardly so that the downwardly folded container walls and the corner plates define a water drain surface tilted downwardly towards the basin; a perforated walk-on floor covering the catch basin; structure for supporting the boat hull on the floor; a steam and hot water generator; a used water treatment apparatus; first pipe means for recycling the used water from the catch basin to the used water treatment apparatus and the steam and hot water generator; and second conduit means connecting the steam and hot water generator with at least one hand-operated hose for flowing the steam and hot water through the hose for discharge onto and cleaning of the boat hull.

The boat cleaning system of the present invention has the important advantage that contaminated, used water generated by it is cleaned and recirculated for reuse. Thus, it is not discharged into sewers or open waters. This system uses a container, and in particular a container which preferably has the standard dimensions of conventional shipping containers, that can be converted into a large boat cleaning area and which has a catching basin located on the ground for collecting the used water. The boat to be cleaned is hoisted onto supports which position it above the catch basin so that the hull can be cleaned of dirt by spraying steam and/or hot water from a flexible hose onto the hull. The walls of the container are pivoted from their upright, closed position into angularly inclined positions which direct the used water into the basin. From there, the used water flows to a treatment section where it is sufficiently cleaned so that it can be reused for further cleaning the hull, or the hull of another boat. Thus, the cleaning system does not have to be as efficient as it would have to be if the used water were discharged into sewers or open waters. Since the entire system is part of a closable container, it can be trailered to wherever it may be needed at different localities, ports, docks, clubs or the like, preferably in the vicinity of a crane to assist its deployment. This enables an economic operation of the system, for example as part of a rental operation or as a traveling business. Since standard containers have a width up to 2.3 m and a length of up to 12.2 m, the working surface that is attained is about 6×16 m. This is sufficient for supporting and cleaning even relatively large yachts. Even longer boats can be supported and progressively cleaned in sections. After use, the entire cleaning system is readily folded back into a closed shipping container for transport to another point of use. All elements and components of the system can be placed into the container for transport.

The cleaning system of the present invention includes a number of embodiments. For example, the catch basin for collecting the used water can have a height of between 0.2 to about 0.5 m. In another embodiment, the basin is covered by a mesh floor which has two tracks on which two or more boat supports are movable to facilitate the positioning of the boat above the used water catch basin. This also facilitates adapting the supports to the different profiles of boat beneath their water line, and it is of course also possible to use boat support structures with different profiles.

In a further embodiment, the cleaning system of the present invention can use automatically actuated steam cleaning nozzles. However, for reasons of cost and for more accurate cleaning, it is normally preferred to use hand-held, high pressure hoses for directing the water or steam towards the hull. Connections are provided for such a hose, preferably in the vicinity of the four corners of the catch basin, so that the steam-hot water jets can be more accurately directed against the hull from all sides. The presently preferred cleaning medium is steam and/or hot water, with or without a cleaning agent added to it. A variety of steam-hot water generators can be used. It is advantageous if the steam-hot water generator includes a compressor to increase the steam or steam-water mixture pressure in the pipes leading to the hose connectors.

It is further preferred to provide the cleaning system with a water tank which holds a quantity of water and supplies the steam-hot water generator via a feed line with previously collected used water that has been cleaned. Since hull cleaning is likely to involve a loss of steam and/or water, additional water is filled into the tank as needed. The present invention can use a variety of used water cleaners. For example, one embodiment employs a cleaning device which removes solids and includes an oil separator as well as an adsorption filter (made of activated charcoal, for example). A suitable electric heater, for example, can be used for heating and evaporating the water, and where climate permits, heating can also be achieved with solar heaters.

To stabilize and properly position the side and end walls when they are unfolded, relatively high support elements are preferably provided which assure that the unfolded walls have a sufficient inclination to form flow surfaces along which the used water can gravitationally drain into the catch basin. To prevent a loss of cleaning water resulting from spraying the water beyond the working surface formed by the unfolded container walls, it is preferred to position upright protective curtains along the periphery of the walls. These can be framed sheets or foils which are connected to the container walls with suitable holding pins that can be inserted in corresponding openings in the container walls. Alternatively, retractable screens, which can be rolled up, for example, can be mounted in boxes located at the periphery of the unfolded container walls between suitable tracks or frames along which the screens can be extended and retracted.

DESCRIPTION OF THE PREFERRED EMBODIMENTS

Figure 1:
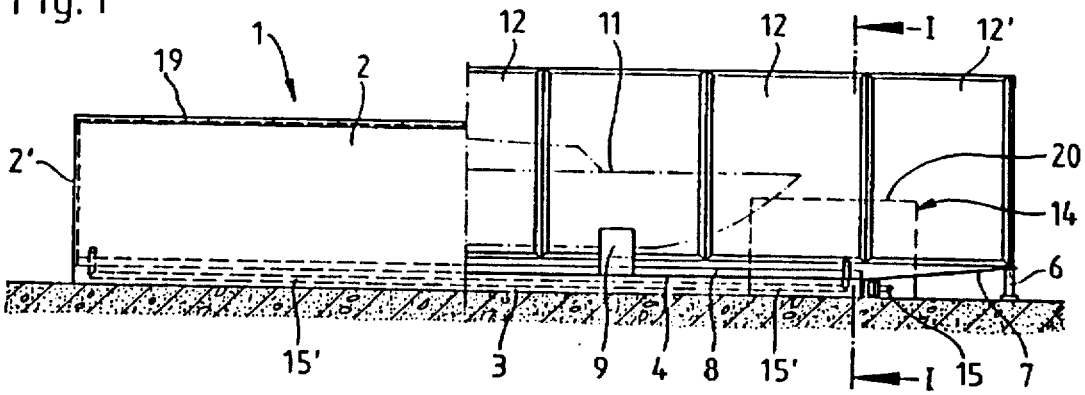
FIG. 1 is a fragmentary view, partially in section (taken along line II—II of FIG. 2), and shows, in the left-hand portion of the figure, the container which forms part of the hull cleaning system of the present invention in its closed position, ready for transport, and in the right-hand half, the container unfolded and in its operative position for cleaning a boat hull illustrated in phantom lines.
Figure 2:
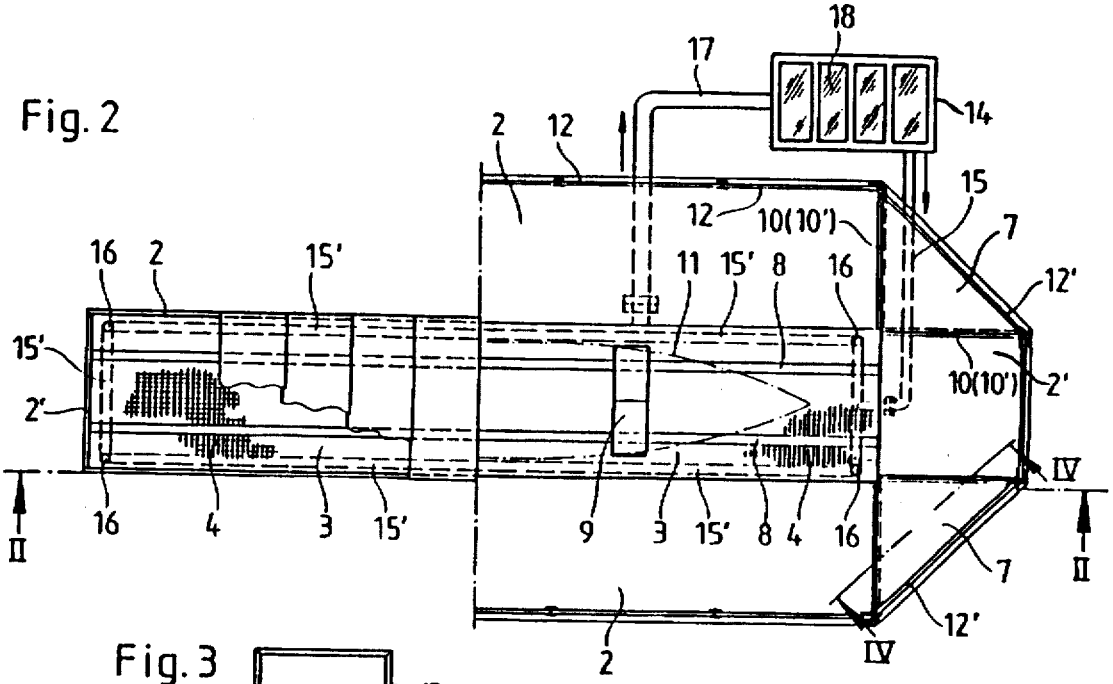
FIG. 2 is a plan view of the boat hull cleaner of the present invention illustrated in FIG. 1.
Figure 3:
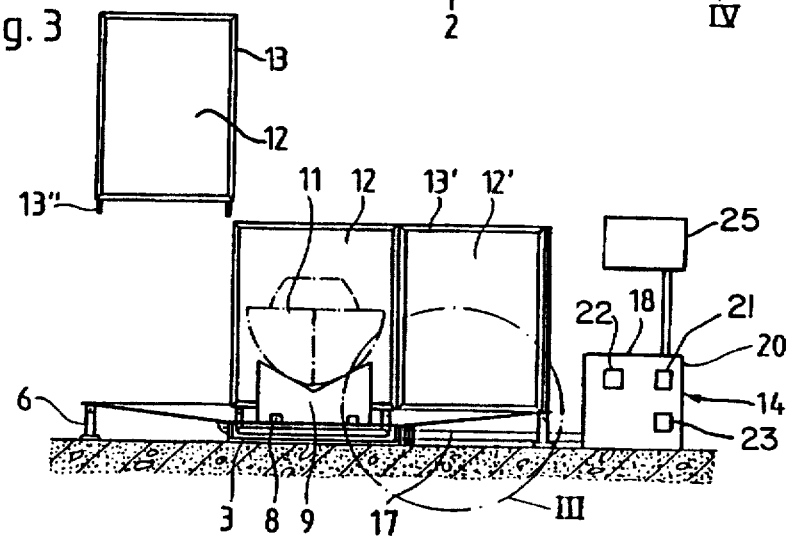
FIG. 3 is a side elevational view, in section, and is taken on line I—I of FIG. 1.
Figure 4:
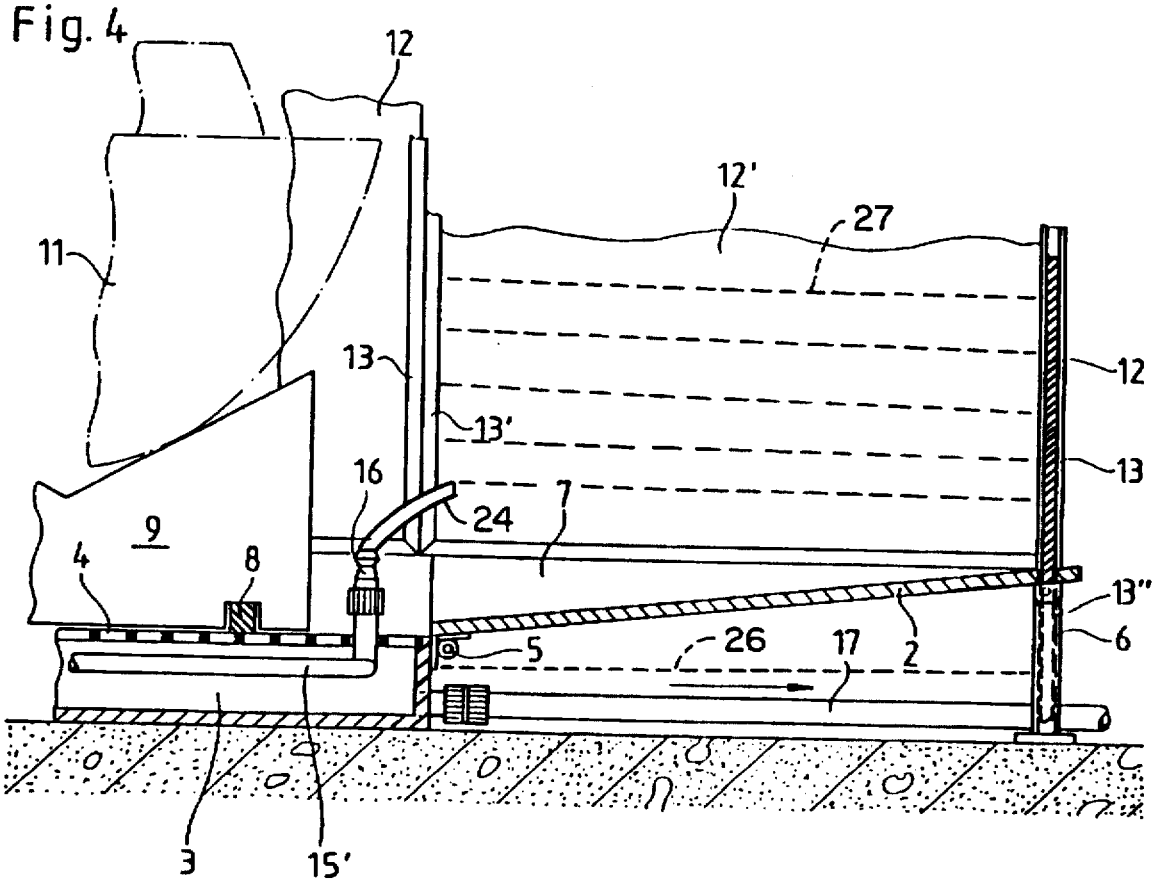
FIG. 4 is a fragmentary, enlarged, side elevational view, partially in section, and illustrates in greater detail the portion of the system of the present invention within phantom line III of FIG. 3.
Figure 5:
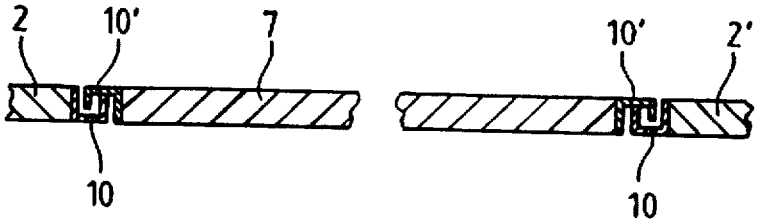
FIG. 5 is a side elevational, fragmentary view, in section, and is taken on line IV—IV of FIG. 2.

Referring to the drawings, a cleaning system made in accordance with the present invention for cleaning boat hulls, particularly hulls of sailing and motor yachts, includes a container 1, preferably of a size equal to the size of conventional transport containers, which, with little effort and cost, can be rendered functional for cleaning boat hulls. Side walls 2 and end walls 2' of the container are mounted on hinges 5 and they can be unfolded, or pivoted outwardly and downwardly (see FIG. 4). In their folded, raised position, the side and end walls are locked in position with suitable latches (not shown). At the bottom, container 1 includes a catch basin 3 for catching and collecting used, contaminated water. It typically has a height of between 0.2 to 0.5 m. As is shown in FIG. 4, hinges 5 are located at the outer or peripheral edges of catch basin 3. An expanded metal mesh floor 4 covers the catch basin and has sufficient strength to support foot traffic. Two spaced-apart guide rails 8 are mounted on mesh floor 4 and they carry two or more boat hull supports 9 which are movable along the rails. In addition, the cleaning system of the present invention includes four corner plates 7. The corner plates, together with the unfolded container walls 2, 2' and connecting profiles 10 at the edges of the container walls and the corner plates, form inwardly and downwardly tilted used water drain surfaces (see FIG. 5). For this purpose, both the container walls 2, 2' as well as corner plates 7 are fitted with support posts 6 having the necessary height. Thus, the inwardly tilted water drain surface is formed by simply unfolding container walls 2, 2', positioning the corner plates 7, and attaching the support posts 6 to them. A boat hull 11 that is to be cleaned can then be lowered onto the appropriately positioned boat hull supports 9 with a crane.

The container 1 is preferably dimensioned so that, in its folded state, it has the maximum permissible container dimensions; that is, a length up to 12.2 m and a width and height of up to 2.3 m. In its unfolded or open state, the cleaning system of the present invention has a work and water drain surface which is about 6×16 m in size. When necessary, boats which are longer than that can also be cleaned by repositioning such boats from time to time on the boat hull supports and cleaning only that section of the boat hull which overlies the water drain surface.

Protective screens 12, 12' for container walls 2, 2' and corner plates 7 are used to prevent cleaning water from spraying beyond the drain surface. A variety of different screen configurations are available. For example, the screens may be made from frames 13, 13' which surround sheets or foils and which, at their lower edge, are provided with holding pins that can be inserted into correspondingly positioned and dimensioned openings along the outer edge or periphery of the container walls. In the illustrated example of the present invention, a lower mounting pin 13" (FIG. 4) extends into the interior of tubular support posts 6. They can be mounted, for example, with a crane that is already available for hoisting the boat hull onto the boat supports. However, the screens can also be differently formed. For example, they can be made as an articulated wall (segments indicated in broken lines 27 in FIG. 4) that can be rolled up into suitable boxes (shown in broken lines in FIG. 4) located along the edges of container walls 2, 2' and corner plates 7. To deploy such retractable screens, they are pulled upwardly and guided along suitable tracks which would replace frames 13, 13'.

An important component of the cleaning system of the present invention is a steam generator and used water treatment apparatus 14. The components and accessories of the steam generator and water treatment apparatus are stored in a supplemental container 20 which, during use of the cleaning installation, is positioned adjacent the unfolded large container 1. The steam generator has its own electrical heater but, where climatically feasible, a solar heater 18 can be used instead. To generate the high steam or steam/water mixture pressures needed for an efficient cleaning of the boat hull, it is preferred to use a compressor which forces the steam or steam-water mixture through a pipe 15 into a ring-shaped steam/hot water distribution conduit 15' located in catch basin 3. A plurality of connectors 16 are provided for fluidly connecting flexible hose 24 with the distribution conduit 15'. In the illustrated embodiment of the present invention, a connector 16 is located in the vicinity of each corner of basin 3. The supplemental container 20 is used to hold and store the components of the used water treatment apparatus. Used water collecting in catch basin 3 flows through a pipe 17 to a location where solids are removed from the water, an oil separator 22, if needed an adsorption filter 23 (for example one made from activated charcoal), and from there into a water tank 25. The latter is fluidly coupled with steam-hot water generator via a feed line. The steam-hot water generator, the compressor, the solids separator 21, the oil separator, and the adsorption filter are well-known components which are stored in the supplemental container 20.

During cleaning, the steam or steam-water mixture is directed onto boat hull 11. Used water drips downwardly and flows over the inwardly inclined drain surface defined by container walls 2, 2' and corner plates 7 into catch basin 3. From there, it is fed via pipe 17 to the used water treatment apparatus and it then reaches the water tank as cleaned water which can be recirculated to the steam generator. After completion of the cleaning operation, pipes 15, 16 are disassembled and, together with the steam generator and used water treatment apparatus, are stored in supplemental container 20 and/or placed inside the main container 1. Its walls 2, 2' are then folded up and corner plates 7 are also stored inside the container. When desired, the main container can include a cover 19.

What is claimed is:

1. Apparatus for cleaning boat hulls comprising a transportable container defined by a catch basin at a lower end of the container and container walls extending upwardly from the basin when the container is closed and foldable downwardly and outwardly relative to the basin, corner plates extending between the container walls when folded downwardly so that the downwardly folded container walls and the corner plates define a water drain surface tilted downwardly towards the basin; a perforated walk-on floor covering the catch basin; means for supporting the boat hull on the floor; a steam and hot water generator; a used water treatment apparatus; first pipe means for recycling used water from the catch basin to the used water treatment apparatus and the steam and hot water generator; and second conduit means connecting the steam and hot water generator with at least one hand-operated hose for flowing steam and hot water through the hose for discharge onto and cleaning of the boat hull.

2. Apparatus according to claim 1 wherein the catch basin includes sides having a height of between 0.2 and 0.5 m.

3. Apparatus according to claim 1 including first and second guide rails mounted on the perforated floor, and including at least first and second means for supporting the boat hull on the perforated floor which are movable along the guide rails.

4. Apparatus according to claim 1 including a flow connector in a vicinity of each corner of the catch basin for fluidly connecting the hose with the second conduit means.

5. Apparatus according to claim 4 including a compressor operatively coupled with the second conduit for flowing the steam and water at high pressure to the hose connectors.

6. Apparatus according to claim 1 including a water tank fluidly connected with the used water treatment apparatus and the steam and water generator for receiving cleaned water from the used water treatment apparatus.

7. Apparatus according to claim 1 wherein the used water treatment apparatus includes a solids separator, an oil separator and an adsorption filter.

8. Apparatus according to claim 1 wherein the steam and hot water generator comprises a solar heater.

9. Apparatus according to claim 1 including support elements connectable with the container walls and the corner plates for supporting them in their tilted positions.

10. Apparatus according to claim 1 including protective screens demountably attached to the container walls and the corner plates when in their tilted positions.

11. Apparatus according to claim 10 wherein the protective screens comprise frames, a sheet carried on and disposed within each frame, and holding pins and corresponding, cooperating, pin receiving openings in the protective walls, the container walls and the corner plates for demountably attaching the protective screens to the corner walls and the corner plates.

12. Apparatus for cleaning boat hulls on land while preventing a contamination of the environment, the apparatus comprising a water catch basin having a generally rectangular outline; side and end walls projecting upwardly from the basin and hinge means permitting the side and end walls to be tilted between upright storage and shipment positions and operative tilted positions in which the walls extend outwardly away from the basin and are downwardly inclined towards the basin; corner plates for attachment to the side and end walls and extending between them so that the corner plates, the side walls and the end walls form a water drain surface directing water into the basin when the walls are in their tilted positions; a water permeable floor on the basin; means for supporting a boat hull above the floor when the side and end walls are in their tilted positions; a used water treatment apparatus; a steam and hot water generator; a flexible hose; and conduit means fluidly connecting the basin, the water treatment apparatus, the steam and hot water generator, and the flexible hose for directing a jet of at least one of steam and hot water from the hose onto the hull for the removal of contaminants adhering to the hull, and for collecting used water dripping off the hull and collecting in the basin and recirculating the used water via the water treatment apparatus, the steam and hot water generator and the flexible hose back against the hull.

* * * * *